US006940031B2

(12) United States Patent
Uehira

(10) Patent No.: US 6,940,031 B2
(45) Date of Patent: Sep. 6, 2005

(54) SWITCHING DEVICE

(75) Inventor: Kiyotaka Uehira, Osaka (JP)

(73) Assignee: Matsushita Electric Industrial Co., Ltd. (JP)

( * ) Notice: Subject to any disclaimer, the term of this patent is extended or adjusted under 35 U.S.C. 154(b) by 0 days.

(21) Appl. No.: 10/501,992

(22) PCT Filed: Mar. 16, 2004

(86) PCT No.: PCT/JP2004/003470

§ 371 (c)(1),
(2), (4) Date: Jul. 21, 2004

(87) PCT Pub. No.: WO2004/086436

PCT Pub. Date: Oct. 7, 2004

(65) Prior Publication Data

US 2005/0098413 A1 May 12, 2005

(30) Foreign Application Priority Data

Mar. 24, 2003 (JP) ..... 2002-080276

(51) Int. Cl.[7] ..... H01H 13/70; H01H 71/16
(52) U.S. Cl. ..... 200/344; 337/37; 337/66
(58) Field of Search ..... 200/5 A, 517, 200/344, 345; 337/36, 37, 56, 62, 66, 85, 113

(56) References Cited

U.S. PATENT DOCUMENTS 3,673,531 A * 6/1972 Zane ..... 337/77
4,109,118 A * 8/1978 Kley ..... 200/5 E
5,975,711 A * 11/1999 Parker et al. ..... 362/24
6,172,868 B1 * 1/2001 Oura ..... 361/680
6,448,520 B1 * 9/2002 Inoue ..... 200/344
6,455,794 B2 * 9/2002 Sato et al. ..... 200/344
6,559,399 B2 * 5/2003 Hsu et al. ..... 200/344
6,713,704 B1 * 3/2004 Yu ..... 200/520

FOREIGN PATENT DOCUMENTS

| | | |
|---|---|---|
| JP | 1-69083 | 5/1989 |
| JP | 4-68424 | 3/1992 |
| JP | 2000-200525 | 7/2000 |
| JP | 2000-207988 | 7/2000 |

* cited by examiner

*Primary Examiner*—Michael A. Friedhofer
(74) *Attorney, Agent, or Firm*—Steptoe & Johnson LLP

(57) ABSTRACT

A switching device in which the intermediate part of shape-memory-alloy wire (17) is retained by actuator (9) connected to one end of link mechanism (4), and both ends of shape-memory-alloy wire (17) are fixedly retained by printed-circuit board (13). Both end parts of shape-memory-alloy wire (17) are fixed on printed-circuit board (13). This shape-memory-alloy wire (17) generates heat due to electric power supplied from the circuit, generates the shape-memory effect to deform. This causes actuator (9) to operate. On this occasion, because the electrically connected part is fixed, even for frequent repetitive operations, damage due to fatigue does not occur, thus improving reliability. In addition, the device can be simplified because it dispenses with a separate part such as a current-carrying wire, and not requiring a process such as an installation work for current-carrying wires offers low-cost switching devices.

10 Claims, 9 Drawing Sheets

SWITCHING DEVICE

TECHNICAL FIELD

The present invention relates to a switching device in which vertical movements of its operation button is controlled arbitrarily.

BACKGROUND ART

A description is made for a switching device disclosed in Japanese Patent Unexamined Publication No. 2000-207988 using FIG. 10.

FIG. 10 illustrates a structure of a switch on a keyboard used for an input device of an electronic device. Pressing key top 101 opens and closes the switch. This key top 101 is retained by link mechanism 102 so that key top 101 is vertically movable. This link mechanism 102 is connected to extension coil spring 103 made of a shape-memory alloy and biasing member 104 made of an elastic body, where key top 101 is usually biased downward by these members. Extension coil spring 103 made of shape-memory alloy is electrically connected to circuit board 105, via stretchable current-carrying wire 106. Supplying electric power from the circuit causes extension coil spring 103 made of shape-memory alloy to contract due to the shape-memory effect, against the force of biasing member 104, actuating link mechanism 102, and then moving up key top 101.

However, the switching device in the above-mentioned conventional example, where extension coil spring 103 made of shape-memory alloy is connected to the circuit for supplying electric power via stretchable current-carrying wire 106, has a problem in that coupling this current-carrying wire 106 with extension coil spring 103 is difficult. Also, there is a problem in that a resistance caused by deformation of current-carrying wire 106 reduces a generated force by the shape-memory effect of extension coil spring 103. Further, as another problem, the coupling part of current-carrying wire 106 and extension coil spring 103 moves in response to stretching and contraction of extension coil spring 103, and thus the coupling part breaks due to repeated stresses applied to the coupling part, resulting in a loss of reliability of the switching device.

SUMMERY OF THE INVENTION

A switching device of the present invention is composed of: an operation button; a link mechanism for driving this operation button vertically; a push-button switch retained on a printed-circuit board, that opens and closes in response to a movement of the operation button; a compression coil spring for biasing the operation button upward; an upper case for controlling the upward movement of operation button; and a lower case fitting the upper case, for containing these parts, wherein an intermediate part of a shape-memory-alloy wire is retained by an actuator where one end of the link mechanism therefore is supported, and wherein both ends of the link mechanism is fixedly retained on the printed-circuit board. In this structure, both ends of the shape-memory-alloy wire are fixed on the printed-circuit board. Even when the shape-memory-alloy wire deforms with its shape-memory effect in response to an electric power supplied by the circuit, to actuate the actuator, a stress does not occur as the electrically connected parts are fixed. Accordingly, even for frequent repetitive operations, the device is not damaged due to fatigue, representing a high reliability. In addition, the device can be simplified because it dispenses with a separate part such as a current-carrying wire, and not requiring a process such as an installation work for current-carrying wires offers low-cost switching devices.

DETAILED DESCRIPTION OF PREFERRED EMBODIMENT

Embodiment

A description is made below for an embodiment of the present invention using FIGS. 1 through 7.

Figure 1A:
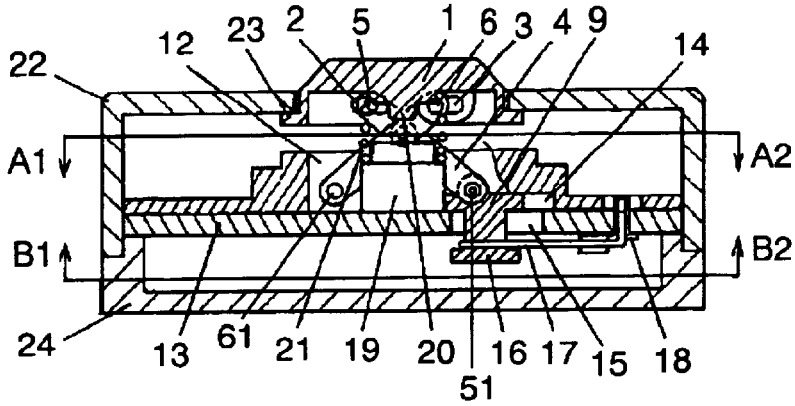
FIG. 1A is a sectional view for illustrating a switching device according to one embodiment of the present invention.
Figure 1B:
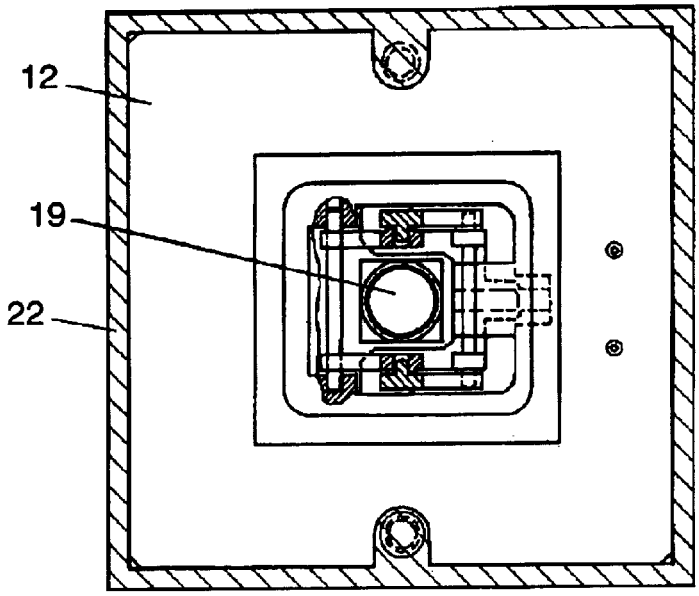
FIG. 1B is a top view of the switching device of FIG. 1A cut off along the line A1–A2.
Figure 1C:
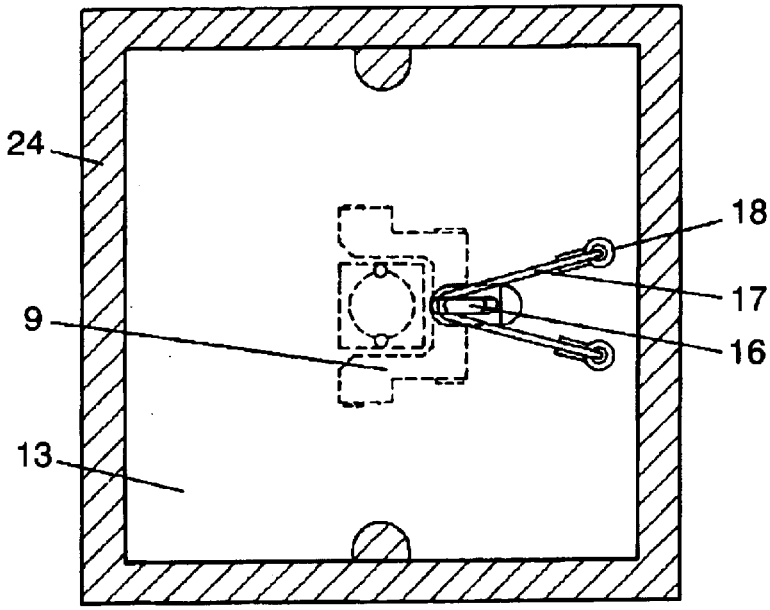
FIG. 1C is a bottom view of the switching device of FIG. 1A cut off along the line B1–B2.
Figure 3A:
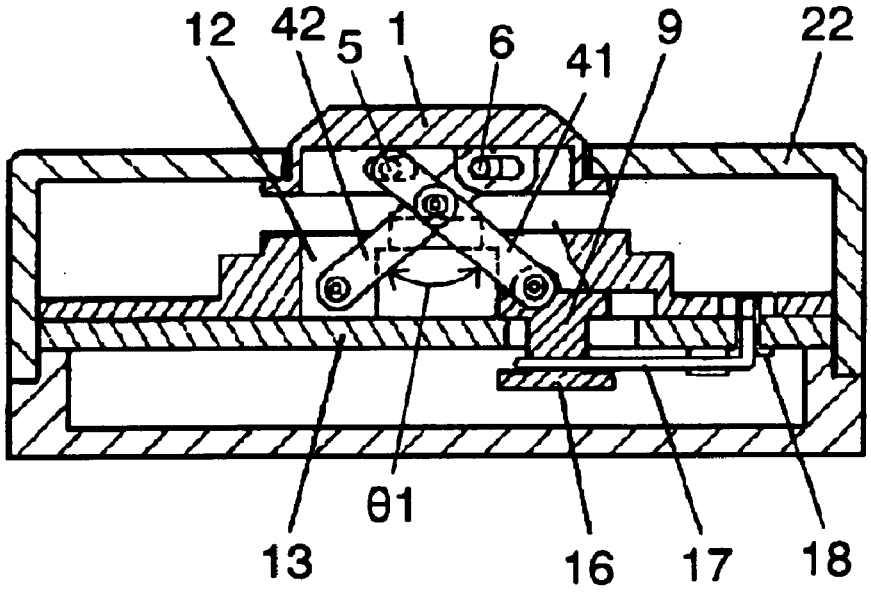
FIG. 3A and FIG. 3B are sectional views for illustrating link mechanisms according to one embodiment of the present invention.

In FIGS. 1A through 1C, on the backside of operation button 1 made of a resin material formed by means such as molding, groove parts 2 and 3 are provided integrally. As shown in FIG. 3A, link mechanism 4 has first arm 41 and second arm 42 both made of a resin material for example, and also has column-shaped projections 5 and 6. Groove parts 2 and 3 mentioned above fit projections 5 and 6, which slide on groove parts 2 and 3. Meanwhile, for end parts 51 and 61 of link mechanism 4, opposite end to operation button 1, end part 61 is fixed to frame 12, and end part 51 is engaged with actuator 9. Frame 12 is arranged on printed-circuit board 13, frame 12 is provided with sliding groove 14, and above-mentioned actuator 9 is arranged so that it can slide on printed-circuit board 13, guided by sliding groove 14, in conjunction with link mechanism 4.

As shown in FIG. 1C, actuator 9 is provided with holding portion 16 projecting downward through through-hole 15 of printed-circuit board 13, and in this holding portion 16, shape-memory-alloy wire 17 is arranged so that it is stretched across with its intermediate part substantially V-shaped. Both ends of shape-memory-alloy wire 17 are fastened to connection terminal 18. This connection terminal 18 is fixed on printed-circuit board 13 by soldering or crimping, and can supply shape-memory-alloy wire 17 with electric power.

On the backside of operation button 1, push-button switch 19 that opens and closes electrically according to vertical movements of operation button 1 is arranged on printed-circuit board 13, and at a part facing push-button switch 19, on the backside of operation button 1, projection 20 is provided. Further, operation button 1 is always biased upward in the figure by compression coil spring 21 provided at the side of push-button switch 19. A movement in which operation button 1 tends to move upward is controlled by an action in which brim part 23 provided on operation button 1 touches upper case 22. Meanwhile, a downward movement of operation button 1 is controlled by an action in which brim part 23 of operation button 1 touches the top surface of the frame 12. With printed-circuit board 13 being retained by lower case 24, upper case 22 is fit to lower case 24. That completes a switching device according to this embodiment where the above-mentioned members are contained in upper case 22 and lower case 24.

Next, a description is made for actions of a switching device according to the present invention, using FIGS. 2A, 2B, 3A and 3B.

Figure 2A:
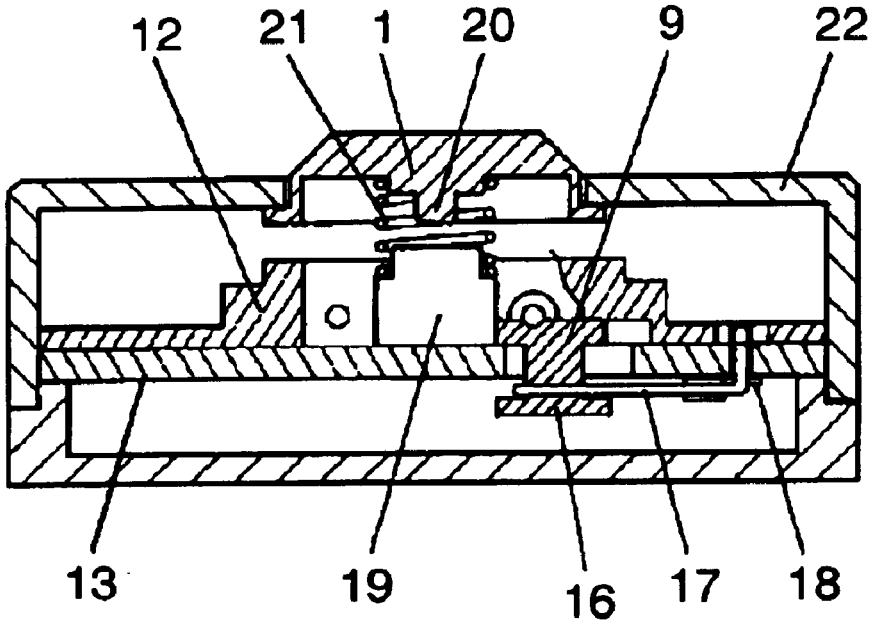
FIG. 2A and FIG. 2B are sectional views for illustrating switching actions according to one embodiment of the present invention.
Figure 2B:
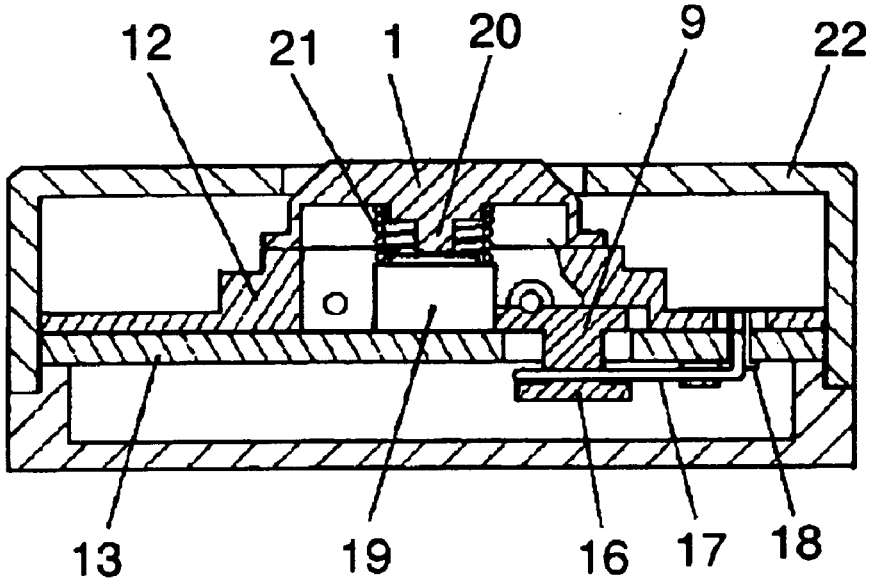

FIG. 2A and FIG. 2B illustrate an action of the switching part of a switching device according to the present invention, where link mechanism 4 is omitted. FIG. 2A shows a state in which operation button 1 is operable, namely operation button 1 is being pushed up to upper case 22 by compression coil spring 21. In this state, projection 20 of operation button 1 is separated from push-button switch 19, where push-button switch 19 gets into an open state. In the open state, when an operator pushes operation button 1 downward, projection 20 provided under operation button 1 pushes down push-button switch 19, where push-button switch 19 gets into a closed state.

Figure 3B:
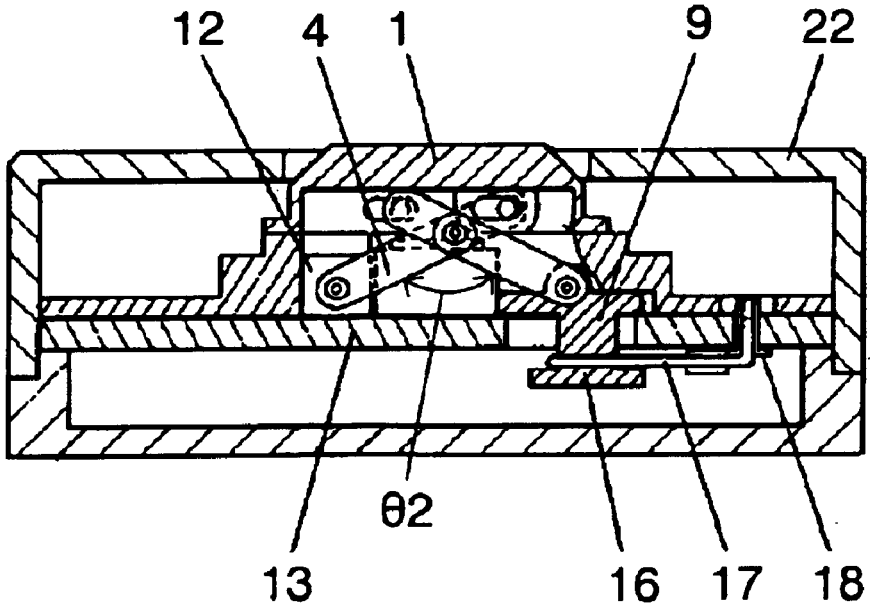

Meanwhile, if it is desired that vertical movements of operation button 1 is controlled not by an operator, but by a signal on the device side, link mechanism 4 can be operated by shape-memory-alloy wire 17. FIG. 3A and FIG. 3B illustrate an action of link mechanism 4 and actuator 9, where compression coil spring 21 is omitted. FIG. 3A shows a state where operation button 1 projects from upper case 22. In this state, operation button 1 is biased upward by compression coil spring 21, as mentioned above, and link mechanism 4 gets into a state where it is extended between operation button 1 and frame 12 by the biasing force. In other words, the cross angle between first arm 41 and second arm 42 becomes an small angle θ1, causing actuator 9 engaged to first arm 4 of link mechanism 4 to be biased to the left direction in FIG. 3A. At this moment, shape-memory-alloy wire 17, held to holding portion 16 provided on actuator 9, in a substantially V-shape form, is in a state shown in FIG. 3A, where projection 20 of operation button 1 is separated from push-button switch 19, and thus push-button switch 19 comes to an open state.

Note that in this embodiment, although a coil spring is used for biasing the operation button upward, the present invention is not confined to a coil spring, but another elastic body such as rubber and a blade spring can be also used.

In this state, supplying electric power with shape-memory-alloy wire 17, through connection terminal 18 fixed to printed-circuit board 13, causes the temperature of shape-memory-alloy wire 17 to rise due to its self-heating, generating the shape-memory effect to generate a contractive force. This contractive force moves actuator 9 from the state in FIG. 3A, to the right direction, and then link mechanism 4 engaged to actuator 9 moves to a direction in which link mechanism 4 contracts between operation button 1 and frame 12. Namely, the cross angle between first arm 41 and second arm 42 becomes angle θ2, which is larger than θ1, operation button 1 locked to first arm 41 moves downward, against the biasing force of compression coil spring 21, and gets into a state shown in FIG. 3B. In the state shown in FIG. 3B, projection 20 provided under operation button 1 pushes down push-button switch 19, causing push-button switch 19 to come to a closed state.

When electric power supply from printed-circuit board 13 to shape-memory-alloy wire 17 is stopped and shape-memory-alloy wire 17 is cooled, the above-mentioned contractive force disappears, and thus operation button 1 returns the state in FIG. 3A owing to a biasing force by compression coil spring 21.

Generally, shape-memory-alloy wire 17, processed in a form of a thin wire, generates a relatively small contractive force, because a generating force due to the shape-memory effect is proportional to the section area. However, as in the embodiment of the present invention, when the intermediate part of shape-memory-alloy wire 17 is arranged so that the intermediate part is held to actuator 9, a contractive force of shape-memory-alloy wire 17 is applied to both sides of holding portion 16 in a V-shaped form, enabling the contractive force to increase largely, as compared to a case where one wire is arranged linearly. Further, both ends of shape-memory-alloy wire 17 do not move because it is fixed mechanically and connected electrically to printed-circuit board 13 through connection terminal 18. Therefore, unlike in the conventional example, connecting a separate part such as stretchable current-carrying wire is not required in order to supply electric power with shape-memory-alloy wire 17. Also, a stress concentration into the connection part does not occur because the connection part does not move even with repeated deformation actions of shape-memory-alloy wire 17, preventing a defect such as a breaking of a wire or poor connection from occurring.

As described above, the shape-memory-alloy wire generates the shape-memory effect with both ends of the shape-memory-alloy wire fixed on the printed-circuit board. This structure prevents a stress to the connection part from occurring when operating the actuator because the electrically connected parts are fixed. Accordingly, even with frequent repetitive operations, damage due to fatigue does not occur, further improving reliability. In addition, because an additional component such as a current-carrying wire is not required, the device can be simplified. A process such as an installation for a current-carrying wire can be omitted, offering low-cost switching devices.

Figure 4A:
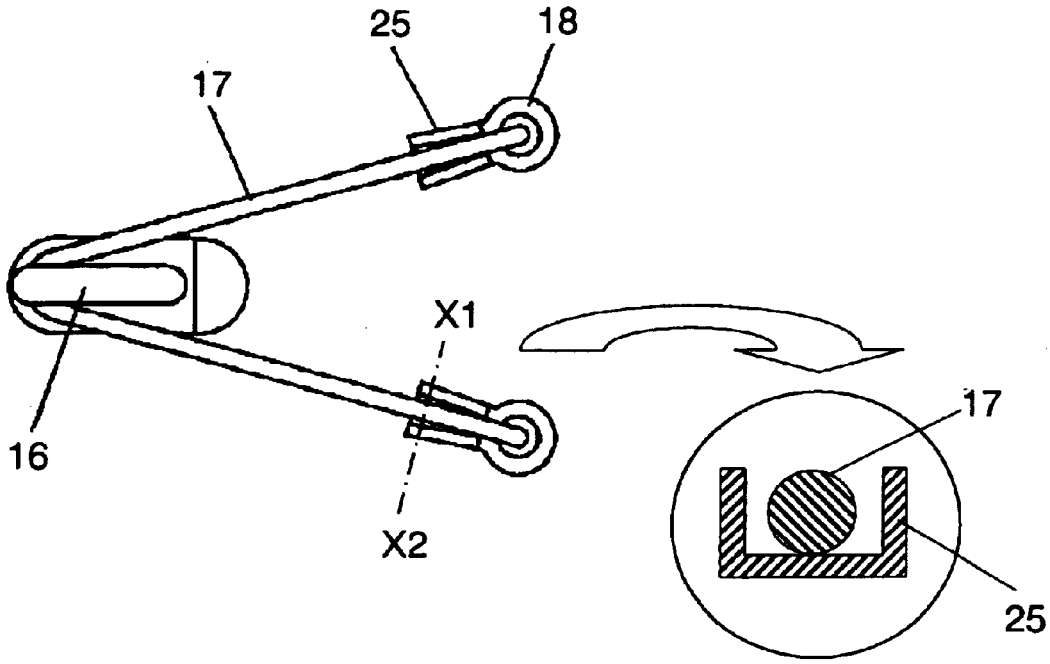
FIG. 4A and FIG. 4B illustrate a connection part according to one embodiment of the present invention.
Figure 4B:
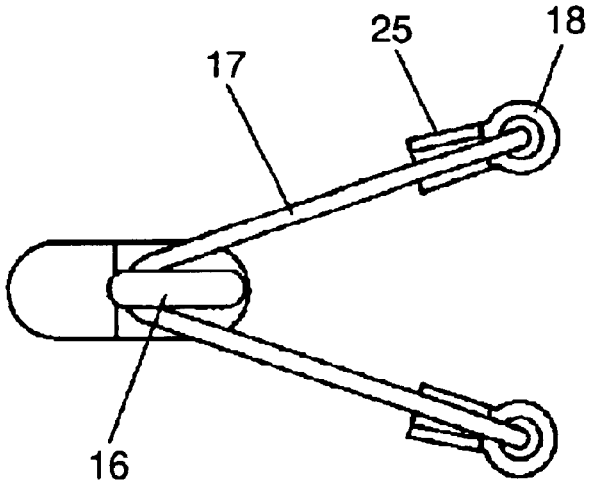
Figure 5A:
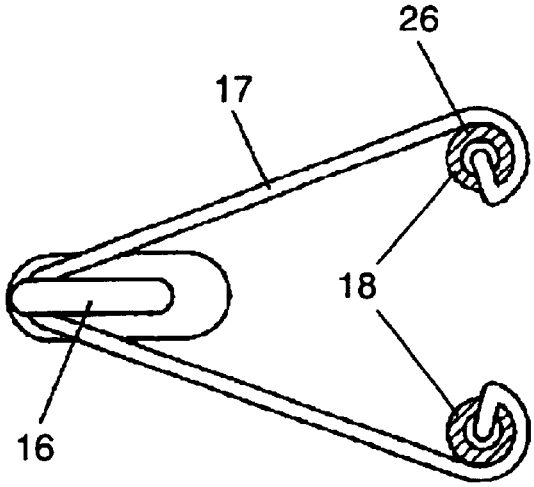
FIGS. 5A through 5D illustrate another connection part according to one embodiment of the present invention.
Figure 5B:
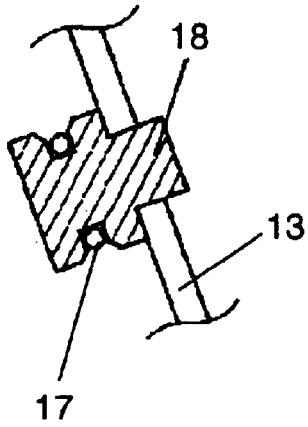
Figure 5C:
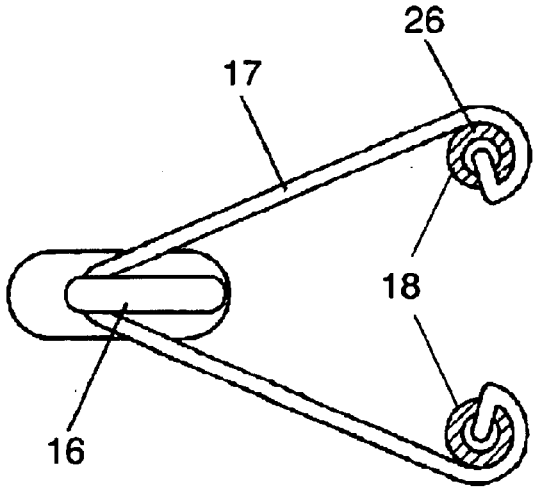
Figure 5D:
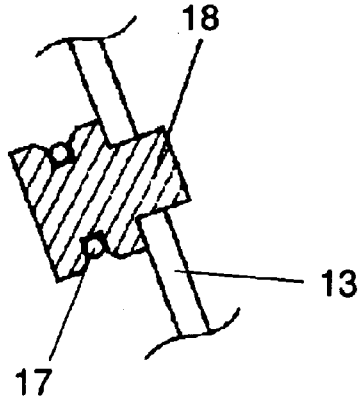

In using connection terminal 18 made of sheet metal processed by metal press, drawing or the like, connection terminal 18 and shape-memory-alloy wire 17 are electrically and mechanically connected by a common coupling method such as soldering and welding. In this case, as shown in FIG. 4A and FIG. 4B, taper part 25 is provided corresponding to the deformation and movement of shape-memory-alloy wire 17, in a direction from connection terminal 18 toward holding portion 16 of actuator 9. In the circle shown in FIG. 4A, an enlarged sectional view along line segment X1–X2 is shown. The two walls of taper part 25 face each other closely near the connection terminal, and distantly with distance from the connection part. Mounting shape-memory-alloy wire 17 along taper part 25 prevents a stress concentration into the fixed part in the stretching action of shape-memory-alloy wire 17, thus improving reliability.

In other words, the connection terminal is provided with a taper part which has a shape such that both a shape-memory-alloy wire 17 in its initial state and the wire in a deformed state where the wire has moved the actuator are successfully received. In the taper part, the shape-memory-alloy wire is freely movable without being influenced by the connection terminal. The result has an advantage in which the reliability of the device is improved. Namely, even after the shape-memory-alloy wire retained by the connection terminal fixed on the printed-circuit board displaces the actuator, a stress concentration in the connection part, due to a sharp deformation such as bending, does not occur, preventing a defect such as a break and poor connection from occurring.

Also, as in an embodiment shown in FIGS. 5A through 5D, connection terminal 18 with a structure in which circular outer edge part 26 is formed around connection terminal 18, and shape-memory-alloy wire 17 is wrapped around the outer edge, can be easily produced by a method such as cutting, implementing the same effect as mentioned above. In addition, with such a structure, thin shape-memory-alloy wire 17 can be used, and thus the heat capacity in self-heating can be made small, reducing the response time of the vertical movement of operation button 1.

As described above, when the outer edge part of the connection terminal is formed so that the cross section is circular, and the shape-memory-alloy wire is retained so that it wraps around the circular outer edge part, the part contacting the connection terminal for the shape-memory-alloy wire both in an initial state and in a state when the shape-memory effect has been generated, can always maintain a smooth arc shape. The result expresses an effect where reliability is improved. Namely, even after the shape-memory-alloy wire retained by the connection terminal fixed on the printed-circuit board displaces the actuator, a stress concentration in the connection part, due to a sharp deformation such as bending, does not occur, preventing a defect such as a break and poor connection from occurring.

Figure 6A:
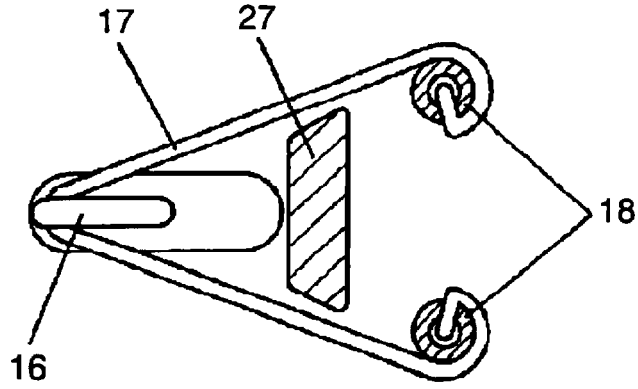
FIG. 6A and FIG. 6B illustrate a structure provided with a heat radiating member according to one embodiment of the present invention.
Figure 6B:
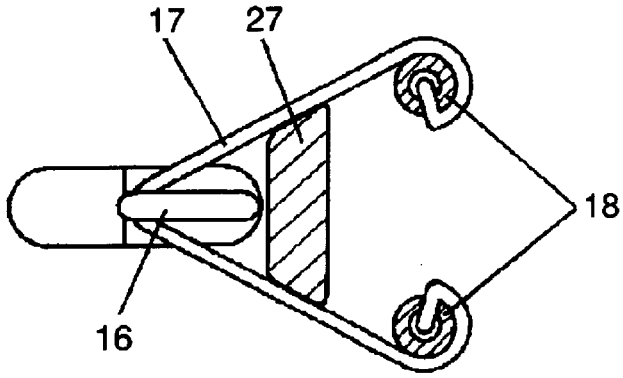

In the embodiment shown in FIG. 6A and FIG. 6B, when shape-memory-alloy wire 17 contracts to move actuator 9 with a supply of electric power, heat radiating member 27 that is made of a metallic material (copper, aluminum, etc.) with a high thermal conductivity, is arranged so that the heat radiating member touches a part of shape-memory-alloy wire 17. The temperature of shape-memory-alloy wire 17 rises due to its self-heating when electric power is supplied, and as its result, wire 17 generates the shape-memory effect to contract. When returning to an original shape, the heat needs to be removed. Therefore, in a case where the temperature is lowered with spontaneous heat radiation, there is a disadvantage of fluctuations in the recovery time in response to the ambient environmental temperature. In a structure as in FIG. 6A and FIG. 6B, shape-memory-alloy wire 17 after its contraction is forcedly cooled by contacting heat radiating member 27 with a large heat capacity, allowing the recovery time to be reduced. Note that in order to make the condition of contacting to heat radiating member 27 more reliable, silicone grease, for example may be applied to either thereof.

As described above, providing a heat radiating member at a position where the member touches a part of the shape-memory-alloy wire when the wire generates heat, let the shape-memory-alloy wire touch the heat radiating member, enabling the heat caused by the shape-memory effect of the wire to go away. This allows the state of the shape-memory-alloy wire to return to its initial state (non-energized state) rapidly, thus improving the response speed of the switch.

Further, in order to reliably control the temperature of heat radiating member 27 itself, it is also possible to arrange a peltiert device on the printed-circuit board to actively control the temperature of heat radiating member 27. This leads to a further reduction of the recovery time against the ambient environmental temperature, thus further improving the response.

Controlling the temperature of the heat radiating member using a peltiert device enables the time of heat dissipation from the shape-memory-alloy wire to be controlled, thus improving the response, which is the recovery time for returning to the initial state (not-energized state) of the shape-memory-alloy wire.

Figure 7:
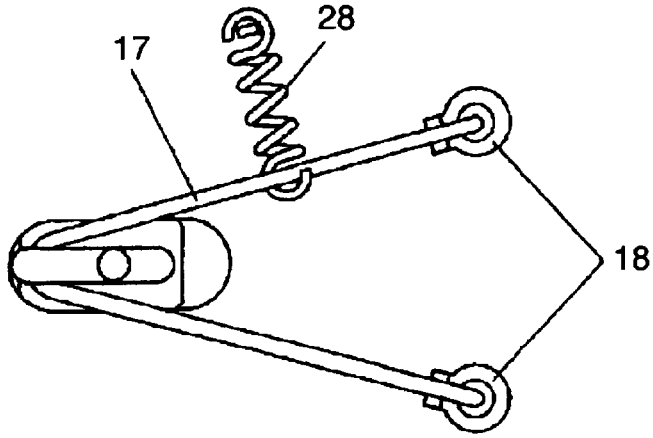
FIG. 7 illustrates a structure provided with an elastic part according to one embodiment of the present invention.

The embodiment in FIG. 7 shows a structure where shape-memory-alloy wire 17 is always tensioned using elastic member 28 formed with an extension coil spring. This allows preventing the following defects. Namely, if looseness occurs caused by a factor such as temperature, an assembly error, and a backlash, in shape-memory-alloy wire 17, when shape-memory-alloy wire 17 contracts, the transmission of the tension to actuator 9 is delayed, deteriorating the response of the switching device.

In such a way, the following effects can be achieved. Namely, by arranging an elastic member for always tensioning the shape-memory-alloy wire, when the shape-memory-alloy wire deforms due to the shape-memory effect, and when a looseness occurs in shape-memory-alloy wire due to a movement of the actuator when an operator operates the operation button, the looseness can be absorbed by the elastic member, and thus preventing a play and backlash of the operation button due to the looseness. Note that the elastic member is not limited to a coil spring, but a rubber elastic body for example can be used. Also, a tension may be applied by pushing, as well as by pulling, the shape-memory-alloy wire, with the above-mentioned elastic member.

Figure 8A:
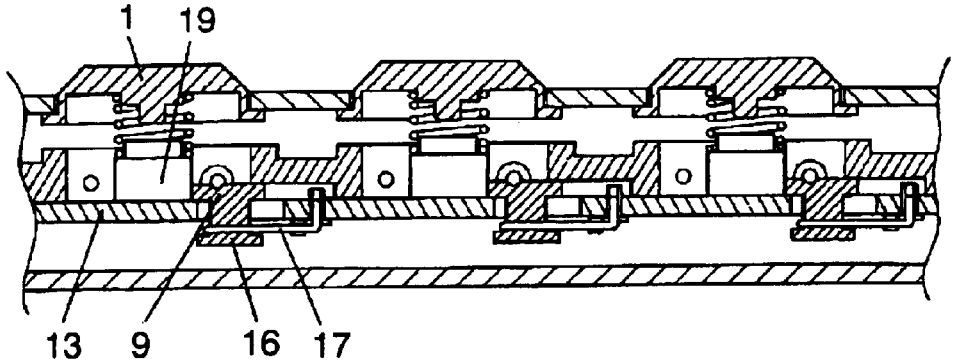
FIG. 8A is a sectional view for illustrating a switching device according to one embodiment of the present invention.
Figure 8B:
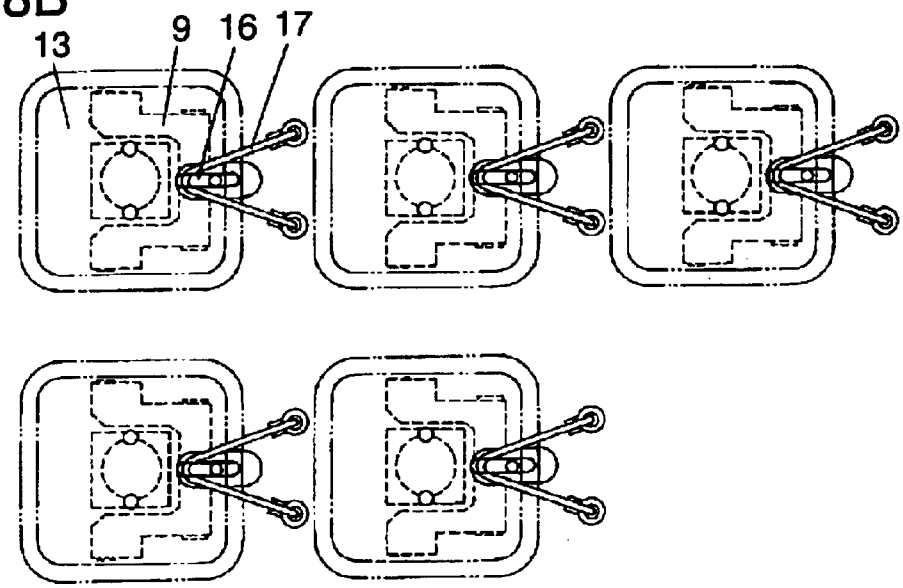
FIG. 8B is a bottom view for illustrating a switching device according to one embodiment of the present invention.
Figure 9:
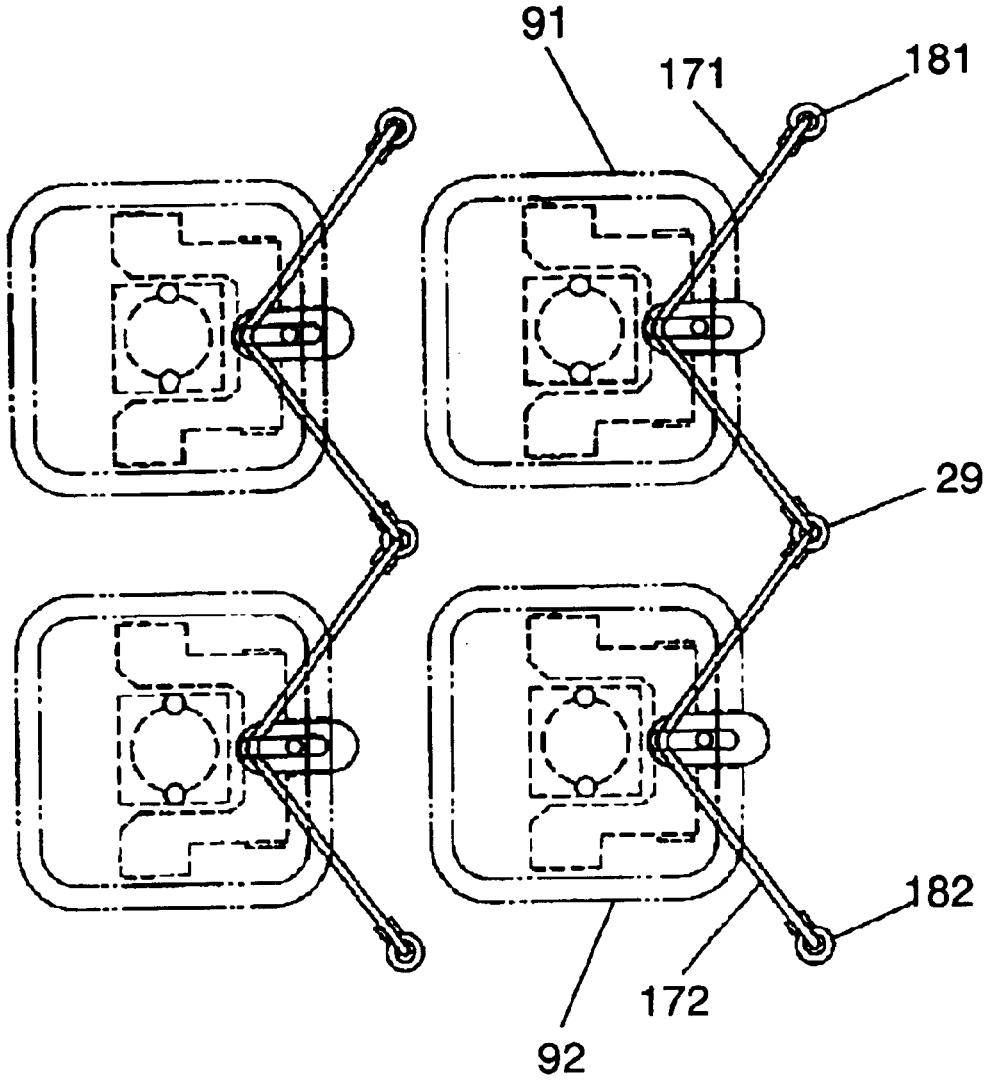
FIG. 9 illustrates a structure provided with a common terminal according to one embodiment of the present invention.
Figure 10:
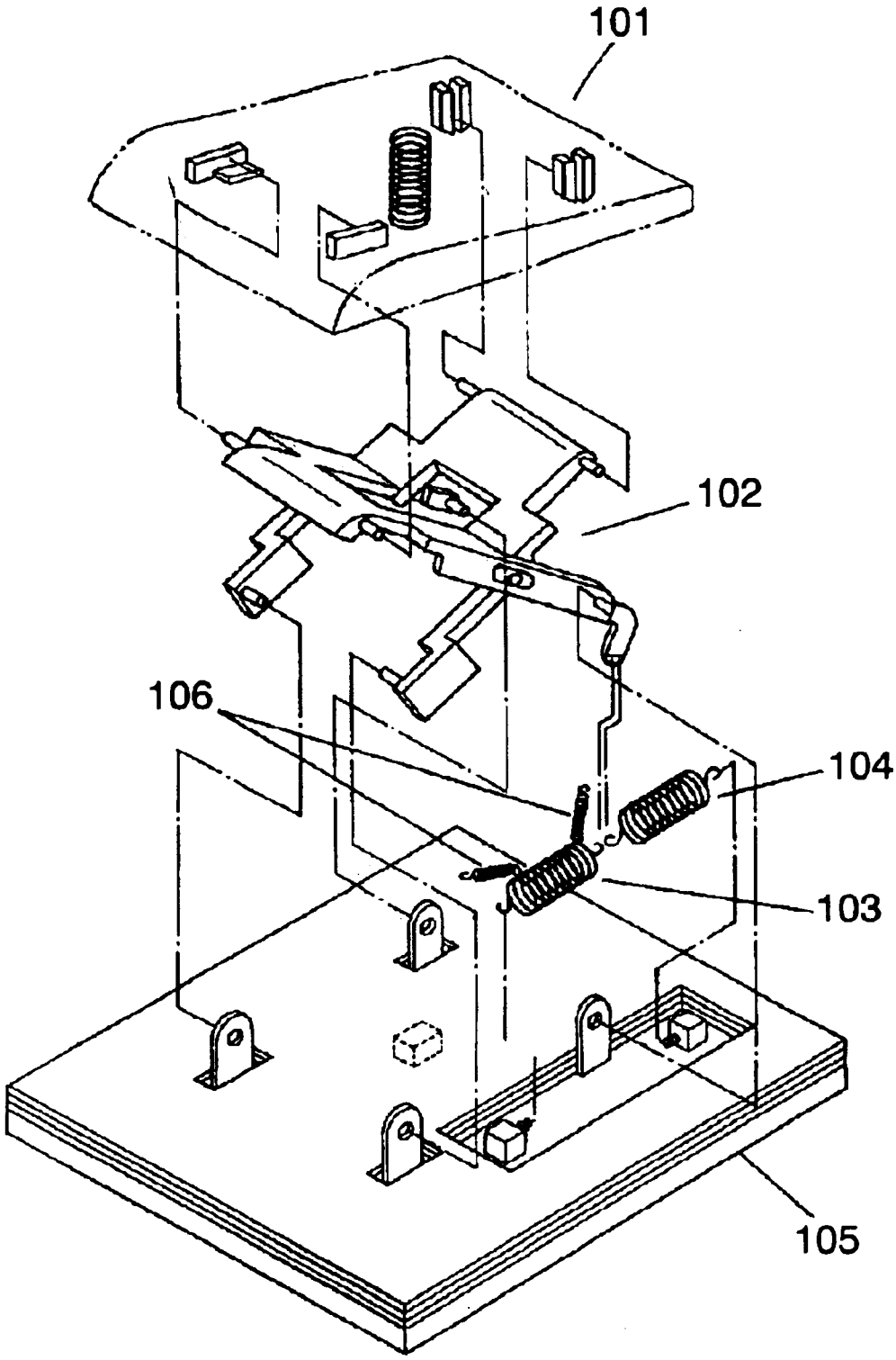
FIG. 10 illustrates a conventional embodiment.

Next, a description is made for another embodiment of the present invention using FIG. 8A, FIG. 8B, and FIG. 9.

In the embodiment shown in FIG. 8A and FIG. 8B, a plurality of switching devices are arranged in a matrix-like form as shown in FIG. 8B. Devices, on which a plurality of switching devices are arranged in this way, include a keyboard for a computer or word processor and input keys for a mobile phone. Such a switching device has operation button 1, link mechanism 4, actuator 9, and push-button switch 19. On printed-circuit board 13, these push-button switches 19 are mounted in a matrix arrangement, and at each position corresponding to each switch, shape-memory-alloy wire 17 is installed. In a case where a number of switching devices are mounted, with a structure according to the embodiment, what is required to control a switching device is that shape-memory-alloy wire 17, substantially V-shaped, is arranged on single printed-circuit board 13, enabling the whole switching device to be simplified, and also the whole device to become slim, which are large practical advantages.

When a plurality of shape-memory-alloy wires are installed to corresponding operation buttons on a printed-circuit board, both ends of the shape-memory-alloy wire can be installed directly on the printed-circuit board. Therefore, even for applying to a device, for example a keyboard, on which a plurality of operation buttons are arranged, a device for controlling vertical movements of an operation button at any position can be easily made. Further, because shape-memory-alloy wires are mounted on a printed-circuit board, connecting to a circuit part for controlling is easy, improving the reliability of the whole device, and enabling simplification of the structure.

Next, a description is made for the embodiment shown in FIG. 9. In FIG. 9, one end of shape-memory-alloy wire 171 used for switching device 91 connects to connection terminal 181, and the other end connects to common terminal 29. Meanwhile, one end of shape-memory-alloy wire 172 used for adjacent switching device 92 connects to connection terminal 182, and the other end connects to common terminal 29. Accordingly, shape-memory-alloy wire 171 electrically connects to shape-memory-alloy wire 172 via common terminal 29.

With an apparatus having a plurality of switching devices, shape-memory-alloy wires 17 are installed corresponding to each operation button 1 in the conventional example. Consequently, the apparatus comes to have a complicated structure, and a number of processes required prevent from supplying low-price switching devices, and reliability of the apparatus becomes low. On the contrary, with the structure according to the present invention, supplying shape-memory-alloy wires 171, 172 of the adjacent switching device with electric power can be done via common terminal 29, and at the same time wiring to the circuit part can be done on single printed-circuit board 13. Therefore, when controlling a number of switching devices, man-hour and the number of components can be reduced, and also the structure of the device can be made simple and the reliability can be improved.

In other words, the switching device of the present invention uses a plurality of shape-memory-alloy wires corresponding to a plurality of operation buttons on a printed-circuit board, and connects one of both ends of a shape-memory-alloy wire commonly to one of both ends of another shape-memory-alloy wire. This structure enables simple structure of both a circuit part and mechanism part for controlling movements of two operation buttons.

In the above description, although shape-memory-alloy wire 17 is formed in a substantially V-shape, the present invention is not limited to the V-shape with a same length of two line segments, but a V-shape with different lengths of two line segments, or a U-shape also can be available. In addition, like a W-character, folding back the V-shaped wire several times gives a large generating force, that goes without saying. Also, when connecting to printed-circuit board 13, although connection terminal 18 is used as a separate component in the above mentioned embodiment, both ends can be directly connected to printed-circuit board 13.

INDUSTRIAL APPLICABILITY

As described above, the present invention offers a switching device where the intermediate part of a shape-memory-alloy wire is retained by a holding portion provided at an actuator whose link mechanism is supported at its one end, and its both ends are fixedly retained by the printed-circuit board. Even for frequent repetitive operations, damage due to fatigue does not occur, thus offering a switching device with a high reliability. In addition, the device can be simplified because it dispenses with a separate part such as a current-carrying wire, and not requiring a process such as an installation work for current-carrying wires offers low-cost switching devices.

What is claim is:

1. A switching device comprising:

a lower case for retaining a printed-circuit board;

an upper case fitting the lower case, for catching the printed-circuit board between inside walls thereof;

an operation button projecting from an opening part provided in the upper case;

a link mechanism having a first arm and a second arm, wherein both arms cross each other for retaining the operation button, wherein the operation button is movable vertically;

a push-button switch fixed on the printed-circuit board under the operation button;

an elastic body provided between the push-button switch and the operation button, wherein the elastic body biases the operation button in the direction away from the push-button switch;

an actuator connected to the first arm, wherein the actuator is movable in parallel with the printed-circuit board;

connection terminals provided on the printed-circuit board; and a wire made of a shape-memory alloy, wherein both ends thereof are fixed to the connection terminals, and wherein an intermediate part thereof is retained by the actuator.

2. A switching device as claimed in claim 1, wherein the elastic body biases the operation button; and wherein the wire made of a shape-memory alloy is tensioned by an action in which the first arm displaces the actuator so that the actuator is separated from the connection terminals.

3. A switching device as claimed in claim 1, wherein each of the connection terminals has a taper part that extends in the shape of a sector at both sides of the wire made of a shape-memory-alloy.

4. A switching device as claimed in claim 1, wherein each of the connection terminals has an outer edge in a circular shape; and wherein the wire made of a shape-memory alloy is allowed to wrap around the outer edge in the circular shape.

5. A switching device as claimed in claim 1, further comprising an elastic member, wherein one end of the elastic member is connected to the wire made of the shape-memory-alloy between the connection terminals and the actuator, allowing the wire made of the shape-memory-alloy to be tensioned.

6. A switching device as claimed in claim 1, further comprising a heat radiating member, wherein the wire made of the shape-memory alloy has a first position occupied when heated, and a second position occupied when unheated; and wherein the wire made of the shape-memory alloy contacts the heat radiating member only at the first position.

7. A switching device as claimed in claim 6, wherein the first position is arranged so that the actuator is pulled toward the connection terminals when the wire made of the shape-memory alloy contracts.

8. A switching device as claimed in claim 6, further comprising a peltiert device on the printed-circuit board, wherein the peltiert device controls the temperature of the heat radiating member.

9. A switching device as claimed in claim 1, wherein the printed-circuit board has a plurality of the switching devices thereon.

10. A switching device as claimed in claim 1, wherein an adjacent switching device on the printed-circuit board shares the connection terminal.

* * * * *

UNITED STATES PATENT AND TRADEMARK OFFICE

CERTIFICATE OF CORRECTION

PATENT NO. : 6,940,031 B2
APPLICATION NO. : 10/501992
DATED : September 6, 2005
INVENTOR(S) : Kiyotaka Uehira It is certified that error appears in the above-identified patent and that said Letters Patent is hereby corrected as shown below:

In the title page, (30) Foreign Application Priority Data should read:

Mar. 24, 2003 (JP) ……2003-080276

The preamble to the claims at column 8, line 41, should read: -- What is claimed is: --

Signed and Sealed this

Sixth Day of May, 2008

JON W. DUDAS
*Director of the United States Patent and Trademark Office*